US011542578B2

(12) United States Patent
Dieudonne et al.

(10) Patent No.: US 11,542,578 B2
(45) Date of Patent: Jan. 3, 2023

(54) SILICON BASED ALLOY, METHOD FOR THE PRODUCTION THEREOF AND USE OF SUCH ALLOY

(71) Applicant: ELKEM ASA, Oslo (NO)

(72) Inventors: Amélie Dieudonne, Ste Colombe (FR); Ole Svein Klevan, Stjørdal (NO)

(73) Assignee: ELKEM ASA, Oslo (NO)

( * ) Notice: Subject to any disclaimer, the term of this patent is extended or adjusted under 35 U.S.C. 154(b) by 207 days.

(21) Appl. No.: 17/251,126

(22) PCT Filed: Jun. 7, 2019

(86) PCT No.: PCT/NO2019/050116

§ 371 (c)(1),
(2) Date: Dec. 10, 2020

(87) PCT Pub. No.: WO2019/240589

PCT Pub. Date: Dec. 19, 2019

(65) Prior Publication Data

US 2021/0140020 A1 May 13, 2021

(30) Foreign Application Priority Data

Jun. 11, 2018 (NO) ..... 20180804

(51) Int. Cl.

| | |
|---|---|
| ***C22C 33/00*** | (2006.01) |
| ***C21C 7/00*** | (2006.01) |
| ***C22C 33/06*** | (2006.01) |
| ***C22C 35/00*** | (2006.01) |
| ***C22C 38/02*** | (2006.01) |

(52) U.S. Cl.

CPC ..... *C22C 33/006* (2013.01); *C21C 7/0006* (2013.01); *C22C 33/06* (2013.01); *C22C 35/005* (2013.01); *C22C 38/02* (2013.01)

(58) Field of Classification Search

CPC ..... C22C 33/006

See application file for complete search history.

(56) References Cited

U.S. PATENT DOCUMENTS 2,608,482 A * 8/1952 Brennan ..... C22C 38/30 420/583
2,866,701 A * 12/1958 Strauss ..... C01B 33/037 75/554

FOREIGN PATENT DOCUMENTS

| | | | |
|---|---|---|---|
| AR | 023865 | A1 | 9/2002 |
| BE | 495194 | A | 8/1950 |
| CN | 1228482 | A | 9/1999 |
| CN | 103602846 | A | 2/2014 |
| CN | 105039833 | A | 11/2015 |
| GB | 930523 | A | 7/1963 |
| GB | 1004443 | A | 9/1965 |
| JP | S44-18058 | Y1 | 8/1969 |
| JP | S45429 | Y1 | 1/1970 |
| JP | S58141361 | A | 8/1983 |
| RU | 2082785 | C1 | 6/1997 |
| SU | 380734 | A1 | 5/1973 |
| WO | WO-00/70113 | A1 | 11/2000 |

OTHER PUBLICATIONS

"Clean Steel: Part Three :: Total Materia Article", May 31, 2007 (May 31, 2007). Retrieved from the Internet: URL:https://www.totalmateria.com/page.aspx?ID=CheckArticle&site=kts&NM=200.

International Search Report and Written Opinion, corresponding International Application No. PCT/NO2019/050116, dated Aug. 12, 2019.

International Preliminary Report on Patentability, corresponding International Application No. PCT/NO2019/050116, dated Apr. 28, 2020.

Chinese Search Report for Corresponding Chinese Application No. 201980038673.7, dated Aug. 27, 2021.

* cited by examiner

*Primary Examiner* — Christopher S Kessler

(74) *Attorney, Agent, or Firm* — Marshall, Gerstein & Borun LLP

(57) ABSTRACT

The present invention relates to a silicon based alloy comprising between 45 and 95% by weight of Si; max 0.05% by weight of C; 0.4-30% by weight Cr; 0.01-10% by weight of Al; 0.01-0.3% by weight of Ca; max 0.10% by weight of Ti; up to 25% by weight of Mn; 0.005-0.07% by weight of P; 0.001-0.02% by weight of S; the balance being Fe and incidental impurities in the ordinary amount, a method for the production of said alloy and the use thereof.

12 Claims, No Drawings

SILICON BASED ALLOY, METHOD FOR THE PRODUCTION THEREOF AND USE OF SUCH ALLOY

CROSS REFERENCE TO RELATED APPLICATIONS

This application is the U.S. National Phase of International Patent Application No. PCT/N02019/050116 filed Jun. 7, 2019, which in turn claims the priority benefit of Norway Patent Application 20180804 filed on Jun. 11, 2018, the respective disclosures of which are incorporated herein by reference in their entireties.

TECHNICAL FIELD

The present invention relates to a silicon based alloy containing chromium, a method for the production thereof and the use of such alloy. The present invention also relates to a silicon based alloy containing chromium and manganese, a method for the production thereof and the use of such alloy.

BACKGROUND ART

Ferrosilicon (FeSi) is an alloy of silicon and iron and is an important additive in the manufacture of steel products. Such alloys are commonly referred to as ferrosilicon alloys but when the silicon content is high and/or when the contents of alloying elements are high, there will be a very small amount of iron in the alloy, and therefore, the term silicon (Si) alloys are also used to denote such alloys. Silicon in the form of ferrosilicon is used to remove oxygen from the steel and as an alloying element to improve the final quality of the steel. Silicon increases namely strength and wear is resistance, elasticity (spring steels), scale resistance (heat resistant steels), and lowers electrical conductivity and magnetostriction (electrical steels). See example of prior art ferrosilicon qualities produced by Elkem in table 1. Special ferrosilicon like LA1 (low aluminium), HP/SHP (High Purity/Semi High Purity) and LC (low carbon) ferrosilicon are used in the production of special steel qualities, such as electrical steel, stainless steel, bearing steel, spring steel, and tire cord steel.

TABLE 1

Examples of qualities in ferrosilicon alloys (all in weight %)

| Qualities | Si | Al max | Ti max | C max |
|---|---|---|---|---|
| Standard FeSi | 74-78 | 1.5 | 0.1 | 0.1 |
| LC FeSi | 74-78 | 1.0 | 0.1 | 0.02 |
| LAl FeSi | 74-78 | 0.1 | 0.1 | 0.04 |
| SHP FeSi | 74-78 | 0.1 | 0.05 | 0.02 |
| HP FeSi | 74-78 | 0.05 | 0.02 | 0.02 |

Ferrochrome is an alloy of chromium and iron, with Cr level typically between 50-70 wt % depending on the grades.

The main polluting element in ferrochrome alloys is carbon that can be from 0.03 up to 9.5 wt %. Examples of commercial Cr alloys are high carbon ferrochrome (HC FeCr) having a carbon content up to 8 wt % typically, charge chrome (chCr) with typically up to 9.5 wt % C, medium carbon ferrochrome (MC FeCr) with typically 1-2 wt % C and different types of low carbon ferrochrome (LCFeCr) from max 0.1 wt % C to max 0.03 wt % C. Other alloys can be available with different carbon content up to 9.5 wt %. FeSiCr is mainly used as a raw material in the production of LC FeCr, but can also be used directly by steel producers as source of Si and Cr units. Such material typically holds a Cr content above 30 wt % and a Si content between 30 and 50%, while carbon content can be guaranteed down to max 0.05%. Table 2 below shows examples of commercial ferrochrome and FeSiCr alloys used in the steel manufacturing industry.

TABLE 2

Examples of commercial ferrochrome and FeSiCr alloys (all in wt %)

| Alloy | Cr | C max | P max | Si max | S max | Source |
|---|---|---|---|---|---|---|
| Charge Cr | Min. 53 | 9.5 | 0.020 | 1.00 | 0.015 | metcoindia |
| HC FeCr | 50-55 | 8.0 | 0.03 | 4.00 | 0.04 | metcoindia |
| MC FeCr | Min. 53 | 2.0 | 0.028 | 0.5 | 0.03 | metcoindia |
| LC FeCr 0.10% C | Min. 60 | 0.10 | 0.03 | 1.0 | 0.03 | metcoindia |
| LC FeCr 0.03% C | Min. 60 | 0.03 | 0.03 | 1.0 | 0.03 | metcoindia |
| FeSiCr | 31 | 0.10 | 0.03 | 47 | 0.02 | Jayesh |
| FeSiCr33 | Min. 40 | 0.9 | 0.03 | 30.0-37.0 | 0.02 | ProEnergoTrading |
| FeSiCr40 | Min. 35 | 0.2 | 0.03 | 37.0-45.0 | 0.02 | ProEnergoTrading |

Ferrochrome is mainly used in stainless steel production in the form of HC FeCr or chCr, as stainless steel grades contain min. 10.5 wt % Cr. This is the minimum level needed to give the steel its stainless properties. Many other steel grades contain Cr addition, mainly in the range 0.5 wt % to 2 wt %, as Cr additions help increasing hardness and scale resistance. Examples of such steels are tool steel, heat resisting steels, high strength steels. Steel producers aim at using high carbon ferrochrome grades as much as possible, as they have the lowest price per Cr unit. However, for some applications, medium carbon and low carbon ferrochrome grades have to be used, in particular when added in the last steps of the steelmaking process, when carbon content needs to be precisely controlled.

In addition, steel grades usually contain Mn, typically in the range 0.2 to 2 wt %, as manganese is an alloying element that improves final properties of the steels like toughness and strength. Therefore, a wide range of steel grades contain both Cr and Mn as alloying elements at the same time, such as spring steel and tool steels. The 200-series stainless steel grades are another example, in which Mn content can be as high as 10 or even 15 wt % with Cr level up to 20 wt %.

Examples of commercial Mn alloys used in steel production are high carbon ferromanganese (HC FeMn) having a carbon content from 6 to 8 wt % typically, medium carbon ferromanganese (MC FeMn) with typically 1-2 wt % C and low carbon ferromanganese (LCFeMn) with about 0.5 wt % C. Also available are electrolytic manganese having down to max 0.04 wt % C. Other alloys can be available with different carbon content up to 8%. It is also worth noting that the lowest carbon content in Mn alloys is found in electrolytic manganese, whose production process is known to create environmental issues and are very costly to produce. Table 3 below shows examples of commercial manganese alloys used in the steel manufacturing industry.

TABLE 3

Examples of commercial manganese alloys (all in wt %)

| Alloy | Mn | C max | P max | Si max | S max | Source |
|---|---|---|---|---|---|---|
| HC FeMn | Min. 78 | 6.5-7.5 | 0.20 | 0.3 | 0.01 | Eramet |
| MC FeMn | 80-83 | 1.5 | 0.20 | 0.6 | 0.01 | Eramet |
| LC FeMn | 80-83 | 0.5 | 0.20 | 0.6 | 0.01 | Eramet |
| Mn metal electrolytic | Min. 99.7 | 0.04 | 0.005 | NA | 0.05 | Changsha Xinye Ind. Co. Ltd |
| Mn metal silicothermic | Min. 95 | 0.2 | 0.07 | 1.8 | 0.05 | Felman trading |

Thus, the object of the present invention is to provide a new silicon based alloy having a low carbon content for the steel manufacturing industry.

Another object is to provide a method of producing said Si based alloy.

A further object is to provide the use of said Si based alloy.

The advantages with the present invention will become evident in the following description.

SUMMARY OF INVENTION

In a first aspect, the present invention relates to a silicon based alloy comprising between 45 and 95% by weight of Si;

max 0.05% by weight of C;
0.4-30% by weight Cr;
0.01-10% by weight of Al;
0.01-0.3% by weight of Ca;
max 0.10% by weight of Ti;
up to 25% by weight of Mn;
0.005-0.07% by weight of P;
0.001-0.02% by weight of S;

the balance being Fe and incidental impurities in the ordinary amount.

In an embodiment, the silicon based alloy comprises between 50 and 80% by weight of Si.

In another embodiment, the silicon based alloy comprises between 64 and 78% by weight of Si.

In an embodiment, the silicon based alloy comprises max 0.03% by weight of C.

In an embodiment, the silicon based alloy comprises 0.01-0.1% by weight of Ca.

In an embodiment, the silicon based alloy comprises max 0.06% by weight of Ti.

In an embodiment, the silicon based alloy comprises between 0.04-0.3% by weight of Mn.

In an embodiment, the silicon based alloy comprises between 0.3-25% by weight of Mn.

In an embodiment, the silicon based alloy comprises between 1-20% by weight of Cr.

In a second aspect, the present invention relates to a method for producing a silicon based alloy as defined above, wherein said method comprises providing a liquid base ferrosilicon alloy and adding a Cr source and optionally Mn source into said liquid ferrosilicon thereby obtaining a melt, and refining said obtained melt, the refining comprising removing formed silicon carbide particles before and/or during casting of said melt.

In an embodiment, the added Cr source is in the form of high carbon ferrochromium alloy, medium carbon ferrochromium alloy, low carbon ferrochromium alloy, Cr metal, or a mixture thereof.

In an embodiment, the added Mn source is in the form of high carbon ferromanganese alloy, medium carbon ferromanganese alloy, low carbon ferromanganese alloy, Mn is metal, or a mixture thereof.

In an embodiment, the liquid base ferrosilicon alloy comprises:

Si: 45-95 wt %;
C: up to 0.5 wt %;
Al: up to 2 wt %;
Ca: up to 1.5 wt %;
Ti: up to 0.1 wt %;
Cr: up to 0.4 wt %
Mn: up to 0.3 wt %;
P: up to 0.02 wt %;
S: up to 0.005 wt %;

the balance being Fe and incidental impurities in the ordinary amount.

In an embodiment, Al is added to adjust the Al content within the range 0.1-10 wt %.

In another aspect, the present invention relates to the use of the silicon based alloy as defined above as an additive in the manufacturing of steel.

In an embodiment, the present invention relates to the use of the silicon based alloy as defined above as an additive in the manufacturing of electrical steel.

DETAILED DESCRIPTION OF THE INVENTION

The present invention provides a new silicon based alloy that is low in carbon and with a chromium content up to 30% by weight. The present invention also provides a new silicon based alloy that is low in carbon and with a chromium content up to 30% by s weight and a manganese content up to 25% by weight.

The alloy according to the invention has the following composition:

Si: 45-95 wt %;
C: max 0.05 wt %;
Cr: 0.4-30 wt %;
Ca: 0.01-0.3 wt %;
Ti: max 0.10 wt %;
P: 0.005-0.07 wt %;
S: 0.001-0.02 wt %;
Mn: up to 25 wt %;
Al: 0.01-10 wt %;

the balance being Fe and incidental impurities in the ordinary amount.

In the present application, the terms silicon based alloy and ferrosilicon based alloy are used interchangeably. Si is the main element in this alloy to be added to the steel melt. Traditionally, 75 wt % Si or 65 wt % Si are used. Ferrosilicon with 75 wt % Si gives higher temperature increase of the steel melt when added than 65 wt % Si, which is almost temperature neutral. Ferrosilicon with lower than 50 wt % Si is rarely used in the steel industry today, and mean that a high amount of alloy would have to be added to get to the targeted Si content in the steel and creating challenges during steelmaking. Higher than 80% is seldom used today, as the production cost per silicon unit increases when the silicon content in the Si based alloy increases. Hence, a preferred Si range is 50-80 wt %. Another preferred Si range is 64-78 wt %.

Chromium is typically an impurity in the production of silicon based alloys. However, the inventors surprisingly found that alloying a silicon based alloy with chromium in the range of 0.4 to 30% while keeping the carbon content low provides an alloy with excellent properties particularly for the use in the production of steel qualities containing Si and Cr and requiring low carbon content. Other possible Cr ranges are 1-25%, 1-20%, or 1-15% or also 2-10%.

For some applications, having a higher Mn content in the Si-based alloy containing Cr while keeping carbon low has also been found to be a good solution. Therefore, raising Mn content above the impurity level can be advantageous for some applications. Manganese is typically an impurity in the production of silicon based alloys, typically in the range up to 0.3 wt %, such as 0.04-0.3 wt %. The present silicon based alloy containing chromium may contain manganese as an alloying element in the range 0.3-25 wt % while keeping the carbon content low. This provides an alloy with excellent properties particularly for the use in the production of steel qualities requiring low carbon content. Other suitable Mn ranges are 1-20 wt %, or 1-15 wt or also 2-10 wt %.

Carbon is the main unwanted element in the steel grades targeted for this new alloy and should be as low as possible in this new alloy according to the invention. A maximum content of carbon in said alloy is 0.05 wt %. A C content of max 0.03 wt % is possible or max 0.02 wt %, as in current low carbon ferrosilicon grades available, or even max 0.01 wt %. It might be difficult to totally remove carbon and therefore normally 0.003 wt % C can be present in the alloy according to the invention.

With chromium increasing in the alloy, the carbon content in the new silicon based alloy according to the invention can be max 0.05 wt %.

Correspondingly, with chromium and manganese increasing in the alloy, the carbon content in the new silicon based alloy according to the invention can be max 0.05 wt %.

Aluminium is typically an impurity in the production of silicon based alloy, typically around 1 wt % out of the furnace in standard grade. For some steels requiring very low aluminium content, it can be refined down to a maximum of 0.01 wt % in the present silicon alloy. In other steels, such as electrical steels, aluminium is also added as an alloying element. Therefore, adding aluminium up to 5 wt % or even up to 10 wt % in the alloy according to the invention can in some instances be preferable.

Calcium is an impurity in the production of silicon based alloys, and should be kept low to avoid problems during steelmaking and casting, such as nozzle clogging. In the alloy according to the invention, the calcium range is 0.01-0.3 wt %. Advantageously, the calcium range is 0.01-0.1 wt %, e.g. max 0.05 wt %. If the calcium content in the starting material for producing the alloy according to the invention is higher than the desired calcium content in said alloy, calcium can be removed during the production by blowing/stirring with oxygen (from air and/or pure oxygen) thereby forming calcium oxide that can be removed as slag.

Titanium is an impurity in the production of silicon based alloys, typically around 0.08 wt % out of the furnace in 75 wt % FeSi standard production, depending on the raw material mix. However, in some steel grades, a low content of titanium is often beneficial to avoid formation of detrimental inclusions. Therefore, a Ti level of max 0.06 wt % or max 0.03 wt %, or even max 0.01 wt % in the new alloy according to the invention is advantageous in some applications like in the production of electrical steel. Traces of Ti might be present in the alloy according to the invention, so that a minimum level of Ti can be 0.003% by weight. It may be challenging to refine Ti in the ladle, so good furnace operation and raw material selection contributes to succeed in getting low titanium content.

Phosphorous is an impurity in the production of silicon based alloys, and is usually below 0.03 wt % in commercial grades of Si-based ferroalloys. Cr alloys usually contain a P level in a similar range as in Si alloys. However, P is normally much higher in Mn alloys, therefore alloying with Mn may lead to a higher P content in the final Si alloy. Therefore, the P level in the present invention is max 0.07 wt %, but can be down to max 0.03 wt %, e.g. when no Mn additions are made in the Si-alloy containing chromium. It is important to note that P content in the steel originating from addition of the silicon alloy of the present invention will be the same or slightly lower than from separate addition of silicon alloy, chrome alloy and manganese alloy.

Sulphur is usually low in silicon alloys production, and is usually below 0.003 wt % in commercial grade of silicon alloys. However, S is normally higher in Cr alloys and slightly higher in Mn alloys, so alloying with Cr and/or Mn may lead to higher S in the final silicon alloy, depending on Cr and Mn contents targeted. Therefore, the S level is max 0.02 wt % in the present invention. It is important to note that S content in the steel originating from addition of the silicon alloy of the present invention will be the same or slightly lower than from separate addition of silicon alloy, chrome alloy and Mn alloy.

In an embodiment, a composition of the alloy according to the invention comprises:

Si: 64-78 wt %;
C: max 0.03 wt %;
Cr: 1-25 wt %;
Ca: 0.01-0.05 wt %;
Ti: max 0.06 wt %;
P: 0.005-0.07 wt %;
S: 0.001-0.02 wt %;
Mn: 0.04-20 wt %;
Al: 0.01-10 wt %;

the balance being Fe and incidental impurities in the ordinary amount.

In another embodiment, a composition of the Si alloy according to the invention comprises ferrosilicon alloyed with Cr, without additions of Mn. Thus, the Mn is present as an impurity:

Si: 45-95 wt %;
C: max 0.05 wt %;
Cr: 0.4-30 wt %;
Ca: 0.01-0.3 wt %;
Ti: max 0.10 wt %;
P: 0.005-0.03 wt %;
S: 0.001-0.02 wt %;
Mn: 0.04-0.3 wt %;
Al: 0.01-10 wt %;

the balance being Fe and incidental impurities in the ordinary amount.

In another embodiment, a composition of the Si alloy according to the invention comprises ferrosilicon alloyed with Cr, with additions of Mn. Thus, the Mn is present as an alloying element:

Si: 45-95 wt %;
C: max 0.05 wt %;
Cr: 0.4-30 wt %;
Ca: 0.01-0.3 wt %;
Ti: max 0.10 wt %;
P: 0.005-0.07 wt %;
S: 0.001-0.02 wt %;
Mn: 0.3-25 wt %;
Al: 0.01-10 wt %;

the balance being Fe and incidental impurities in the ordinary amount.

The alloy according to the present invention is made by adding a Cr source comprising carbon as an alloying element or as an impurity element into a liquid Si based alloy. The Cr source can be in the form of solid or liquid chromium units, in the form of a chromium ferroalloy or chromium metal or a mixture thereof. The chromium source can comprise normal impurities/contaminants. The chromium source can for example be a ferrochromium alloy, such as high carbon ferrochrome, medium carbon ferrochrome, low carbon ferrochrome, or chromium metal or a mixture thereof. A commercial chromium ferroalloy, for example as given in table 2 above, or a commercial chromium metal or a combination of two or more of such alloys, are suitable for use in the present invention. Preferably the added Cr is in the form of high carbon ferrochrome or medium carbon ferrochrome.

The added carbon from the chromium source will react with silicon thereby forming solid SiC (silicon carbide) particles that during refining are removed from the melt to the ladle refractory or to any slag that has been formed before or during the casting process, preferably with stirring in the ladle. Slag formers can be added if needed to have a sufficiently large receptor for the formed SiC particles. This results in a Si alloy according to the invention with low carbon content and containing chromium, with the range of elements as indicated above.

If manganese is to be present in the final product (up to 25%), addition of solid or liquid manganese units can be made in the ladle together with the Cr addition. Mn can be added to adjust the Mn content within the range 0.3-25 wt %. The Mn source can be in the form of solid or liquid manganese units, in the form of a manganese alloy or manganese metal or a mixture thereof. The manganese source can comprise normal impurities/contaminants. The manganese alloy can for example be a ferromanganese alloy, such as high carbon ferromanganese, medium carbon ferromanganese, low carbon ferromanganese or a mixture thereof. A commercial manganese alloy, for example as given in table 3 above, or a combination of two or more of such alloys, are suitable for use in the present invention. Preferably the added Mn is in the form of high carbon ferromanganese or medium carbon ferromanganese.

The added carbon from the manganese source will react with silicon, in the same manner as described above for the carbon added by the chromium source, thereby forming solid SiC (silicon carbide) particles that during refining are removed from the melt to the ladle refractory or to any slag that has been formed before or during the casting process, preferably with stirring in the ladle. Slag formers can be added if needed to have a sufficiently large receptor for the formed SiC particles. By this method, a Si alloy according to the invention with low carbon content and containing chromium and manganese, with the range of elements as indicated above, is produced.

An example of a composition for the starting material could be liquid FeSi from the furnace, but many others are possible depending on the final specification to be reached. Remelting any commercial silicon based alloys like standard ferrosilicon or high purity ferrosilicon could also be a possible starting material.

Thus, a possible starting material can comprise:

Si: 45-95 wt %;
C: up to 0.5 wt %;
Al: up to 2 wt %;
Ca: up to 1.5 wt %;
Ti: up to 0.1 wt %;
Cr: up to 0.4 wt %
Mn: up to 0.3 wt %;
P: up to 0.02 wt %;
S: up to 0.005 wt %;

the balance being Fe and incidental impurities in the ordinary amount.

If aluminium is to be present in the final product (up to 10%), addition of solid or liquid aluminium units can be made in the ladle. Alternatively, aluminium in liquid ferrosilicon from the furnace can be increased by selection of raw materials to the furnace. Al can be added to adjust the Al content up to 10%.

To produce the alloy according to the invention, additional steps involving slag refining, skimming and/or stirring according to generally known techniques can be performed, in particular to reach the low levels of carbon claimed by the present invention. Such steps can be performed before or during the casting process or in combination.

The following Example illustrates the present invention without limiting its scope.

EXAMPLE 1

Ferrosilicon was tapped as normal into a tapping ladle with bottom stirring with air. The amount of liquid ferrosilicon was about 7800 kg. Table 4 shows the chemical composition of the starting material before addition of the ferrochrome.

TABLE 4

Chemical composition of starting material (wt %).

| | Al | Si | P | Ca | Ti | Mn | C | Cr |
|---|---|---|---|---|---|---|---|---|
| Starting material | 0.42 | 67.57 | 0.008 | 0.075 | 0.057 | 0.11 | 0.015 | 0.17 |

After tapping the ladle was taken to the alloying and casting area. Then 401 kg lumpy HCFeCr, with 67.61 wt % Cr, 7.23 wt % C, 0.92 wt % Si; the balance being Fe and incidental impurities in the ordinary amount, was added into the liquid ferrosilicon with aim to reach 3 wt % Cr in the final product. As the Cr yield was not known, the HCFeCr was added gradually in 4 batches of 100 kg each over a 8-10 min period and until the Cr target of 3 wt % was reached. (Additions can be done in a shorter or over a longer time). The bottom stirring was kept during the whole addition process. After the HCFeCr alloys was added, formed SiC particles were removed during refining and the ladles were taken to the casting area where the liquid material was casted into cast iron moulds.

is A sample of the new alloy according to the invention produced was taken after casting, at pre-crushed stage. Results are shown in table 5.

All samples were analyzed with XRF (Zetium® from Malvern Panalytical) for Al, Cr, Si, P, Ca, Ti, Mn, and for C, LECO® CS-220 (combustion analysis) was used.

TABLE 5

| Analysis (wt %) on pre-crushed material. | | | | | | | | |
|---|---|---|---|---|---|---|---|---|
| | Al | Si | P | Ca | Ti | Mn | C | Cr |
| Final analysis | 0.27 | 65.49 | 0.007 | 0.035 | 0.056 | 0.13 | 0.007 | 2.94 |

By applying such method, the inventors achieved a low carbon level, which can be explained by the low solubility of carbon in high silicon alloys. It was however surprising that it was possible to reach carbon levels as low as in current low carbon ferrosilicon grades (see table 1).

The alloy according to the invention is a cost-efficient alternative to current methods by adding the required alloying elements Si and Cr separately as a lower carbon type of ferrosilicon in combination with a ferrochrome alloy, by improving process time and quality. Said alloy could also help steel producers to decrease the overall carbon content in the steel and reach a lower level than by adding ferrosilicon/Si based alloy and chromium in the form of low carbon ferrochrome alloy separately. Further, said alloy could allow steel producers to make new grades with higher Cr level and at the same keep the carbon content low in the steel using only one alloy additive.

The alloy according to the invention is also a cost-efficient alternative to current methods whereby adding the required alloying elements Si, Cr and Mn separately as lower carbon type of ferrosilicon in combination with ferrochrome and ferromanganese alloys or manganese metal, by that improving process time and quality. Said alloy could also help steel producers to decrease the overall carbon content in the steel and reach a lower level than by adding ferrosilicon/Si based alloy, chromium in the form of low carbon ferrochrome alloy and manganese in the form of low carbon ferromanganese or manganese metal separately. Further, said alloy could allow steel producers to make new grades with higher Cr level and higher Mn level and at the same keep the carbon content low in the steel using only one alloy additive.

Having described different embodiments of the invention it will be apparent to those skilled in the art that other embodiments incorporating the concepts may be used. These and other examples of the invention illustrated above are intended by way of example only and the actual scope of the invention is to be determined from the following claims.

The invention claimed is:

1. A silicon based alloy comprising:
between 45 and 95 % by weight of Si;
max 0.05 % by weight of C;
1-20 % by weight Cr;
0.01-10% by weight of Al;
0.01-0.3% by weight of Ca;
max 0.10 % by weight of Ti;
up to 25% by weight of Mn;
0.005-0.07 % by weight of P;
0.001-0.02 % by weight of S; and
the balance being Fe and incidental impurities.

2. The silicon based alloy according to claim 1, wherein the silicon based alloy comprises between 50 and 80 % by weight of Si.

3. The silicon based alloy according to claim 2, wherein the silicon based alloy comprises between 64 and 78 % by weight of Si.

4. The silicon based alloy according to claim 1, wherein the silicon based alloy comprises max 0.03 % by weight of C.

5. The silicon based alloy according to claim 1, wherein the silicon based alloy comprises between 0.01-0.1 % by weight of Ca.

6. The silicon based alloy according to claim 1, wherein the silicon based alloy comprises max 0.06 % by weight of Ti.

7. The silicon based alloy according to claim 1, wherein the silicon based alloy comprises between 0.04-0.3 % by weight of Mn.

8. The silicon based alloy according to claim 1, wherein the silicon based alloy comprises between 0.3-25 % by weight of Mn.

9. A method for producing a silicon based alloy according to claim 1, wherein said method comprises:
providing a liquid base ferrosilicon alloy comprising:
Si: 45-95 wt %,
C: up to 0.5 wt %,
Al: up to 2 wt %,
Ca: up to 1.5 wt %
Ti: up to 0.1 wt %,
Cr: up to 0.4 wt %,
Mn: up to 0.3 wt %,
P: up to 0.02 wt %,
S: up to 0.005 wt %,
the balance being Fe and incidental impurities;
adding a Cr source comprising carbon and optionally Mn source into said liquid ferrosilicon thereby obtaining a melt; and
refining said obtained melt, the refining comprising removing formed silicon carbide particles before and/or during casting of said melt.

10. The method according to claim 9, wherein the added Cr source is in the form of high carbon ferrochromium alloy, medium carbon ferrochromium alloy, low carbon ferrochromium alloy, Cr metal, or a mixture thereof.

11. The method according to claim 9, wherein the added Mn source is in the form of high carbon ferromanganese alloy, medium carbon ferromanganese alloy, low carbon ferromanganese alloy, Mn metal, or a mixture thereof.

12. The method according to claim 9, wherein Al is added to adjust the Al content up to 10 wt %.

* * * * *